US009802167B2

(12) United States Patent
Stroh et al.

(10) Patent No.: US 9,802,167 B2
(45) Date of Patent: Oct. 31, 2017

(54) TURBO JET MIXER

(71) Applicant: Knighthawk Engineering, Inc., Houston, TX (US)

(72) Inventors: Carroll Stroh, Houston, TX (US); Cliff Knight, Houston, TX (US); Erik Howard, Houston, TX (US)

(73) Assignee: KNIGHTHAWK ENGINEERING, INC., Houston, TX (US)

( * ) Notice: Subject to any disclaimer, the term of this patent is extended or adjusted under 35 U.S.C. 154(b) by 211 days.

(21) Appl. No.: 14/018,020

(22) Filed: Sep. 4, 2013

(65) Prior Publication Data

US 2015/0059867 A1 Mar. 5, 2015

(51) Int. Cl.

| | |
|---|---|
| ***B05B 3/06*** | (2006.01) |
| ***B01F 5/02*** | (2006.01) |
| ***B01F 5/10*** | (2006.01) |
| ***B08B 9/093*** | (2006.01) |
| ***B05B 3/00*** | (2006.01) |
| ***B05B 13/06*** | (2006.01) |

(52) U.S. Cl.

CPC ..... *B01F 5/0231* (2013.01); *B01F 5/10* (2013.01); *B05B 3/003* (2013.01); *B05B 3/005* (2013.01); *B05B 3/06* (2013.01); *B05B 13/0636* (2013.01); *B08B 9/0933* (2013.01); *B08B 9/0936* (2013.01); *Y10T 137/4245* (2015.04)

(58) Field of Classification Search

CPC . Y10T 137/86413; B05B 3/003; B05B 3/005; B05B 3/06; B05B 13/0636; B05B 13/169; B05B 13/005

See application file for complete search history.

(56) References Cited

U.S. PATENT DOCUMENTS

| | | | | |
|---|---|---|---|---|
| 4,244,524 | A * | 1/1981 | Wellings | 239/227 |
| 4,421,275 | A * | 12/1983 | Gratton | 239/226 |
| 5,060,863 | A * | 10/1991 | Hammelmann | 239/252 |
| 5,301,702 | A * | 4/1994 | McKinney | 134/167 R |
| 5,779,160 | A * | 7/1998 | Rucker | B05B 3/0445 239/463 |
| 6,209,802 | B1 * | 4/2001 | Koivunen | 239/252 |
| 6,561,199 | B2 * | 5/2003 | Gleeson et al. | 134/22.18 |
| 7,100,842 | B2 * | 9/2006 | Meyer et al. | 239/214 |
| 2015/0001314 | A1 * | 1/2015 | Wojciechowski et al. | 239/264 |

* cited by examiner

*Primary Examiner* — Matthew W Jellett
(74) *Attorney, Agent, or Firm* — Adolph Locklar

(57) ABSTRACT

A tank cleaning machine comprising a housing having an inlet and a stationary guide diverter disposed within the housing. A gearing mechanism is attached to the stationery flow diverter. A nozzle extends from the housing wherein the nozzle is in fluid communication with the inlet and the nozzle includes an inclined portion extending from a horizontal portion of the nozzle. A drag limiter extends into a hydraulic fluid reservoir to limit the rotation speed of the gear.

6 Claims, 11 Drawing Sheets

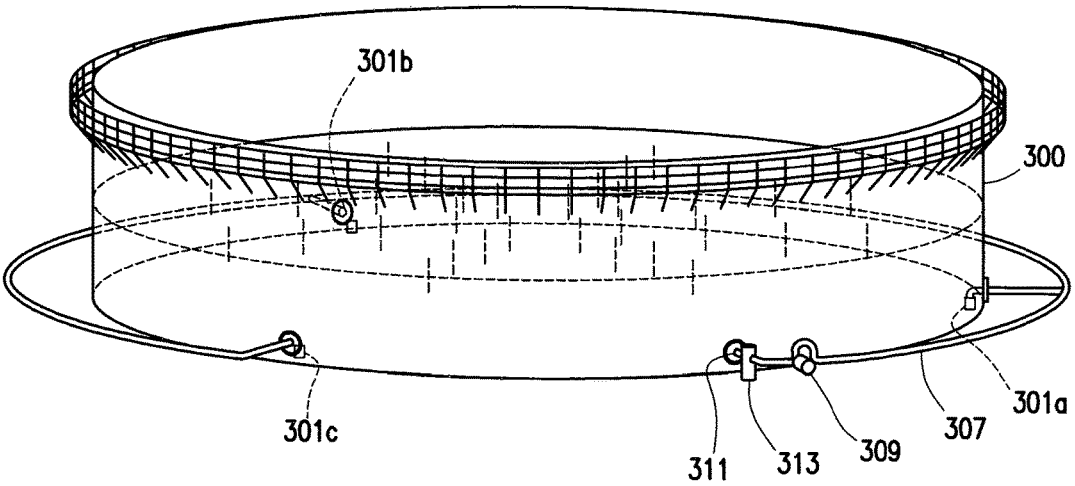
FIG. 9a
FIG. 9b
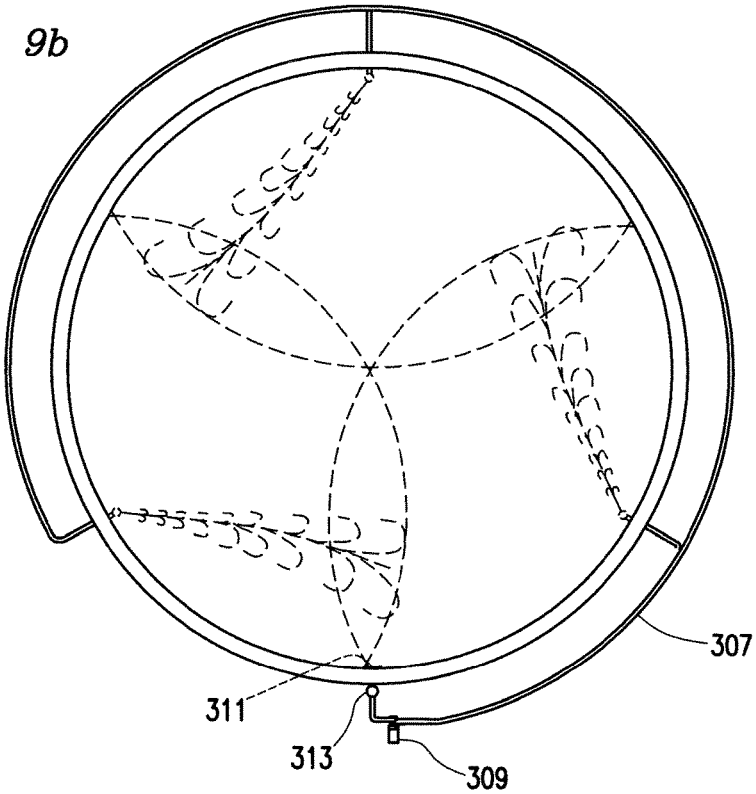

TURBO JET MIXER

BACKGROUND

The present disclosure generally relates to systems and methods of fluid cleaning storage tanks.

The accumulation of sludge on the bottom of crude oil storage tanks results in a number of operational problems. For example the capacity of the storage tank is reduced due to sludge build up that occupies storage capacity of the tank. Also, the sludge deposits may trap pools of water which later form water slugs in the outflow from tank, the sludge causes uneven landing of the legs of the floating roof and alternative use of the tank for other oil types and products is prevented. To minimize these problems, sludge deposits are often periodically removed by physically entering the storage tank. However, the process of cleaning storage tanks by physical entry is costly and may be a potential hazard to personnel.

SUMMARY OF THE INVENTION

Embodiments of the present disclosure provide for a turbo jet mixer. The turbo jet mixer may include an inner housing having an inlet. The inner housing may include a coupling section, a generally tubular section, and an end plate, the interior of the generally tubular section defining an inner chamber. The turbo jet mixer may also include an outer housing positioned substantially about the inner housing, the outer housing being rotatably coupled to the inner housing, the outer housing having an inner wall. The turbo jet mixer may also include a nozzle coupled to the outer housing, the nozzle coupled to an aperture in the outer housing to fluidly connect the inner chamber to the nozzle. The turbo jet mixer may also include a continuously rotatable dashpot coupled to the inner housing and a gearing mechanism coupled to the inner housing positioned to operatively couple a ring gear coupled to the outer housing to the dashpot.

Embodiments of the present disclosure also provide for a turbo jet mixer. The turbo jet mixer may include a housing having an inlet; a stationery flow diverter disposed within the housing; a gearing mechanism that is attached to the stationery flow diverter, wherein at least a portion of the housing is attached to the gearing mechanism; a nozzle extending from the housing wherein the nozzle is in fluid communication with the inlet, and wherein the nozzle includes an inclined portion extending from a horizontal portion of the nozzle; and a drag limiter that extends into a hydraulic fluid reservoir within the housing to limit the rotation speed of the gear.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 9*a*, 9*b* depict a configuration of a turbo jet mixer in accordance with the present disclosure in a storage tank.

DETAILED DESCRIPTION

Figure 1:
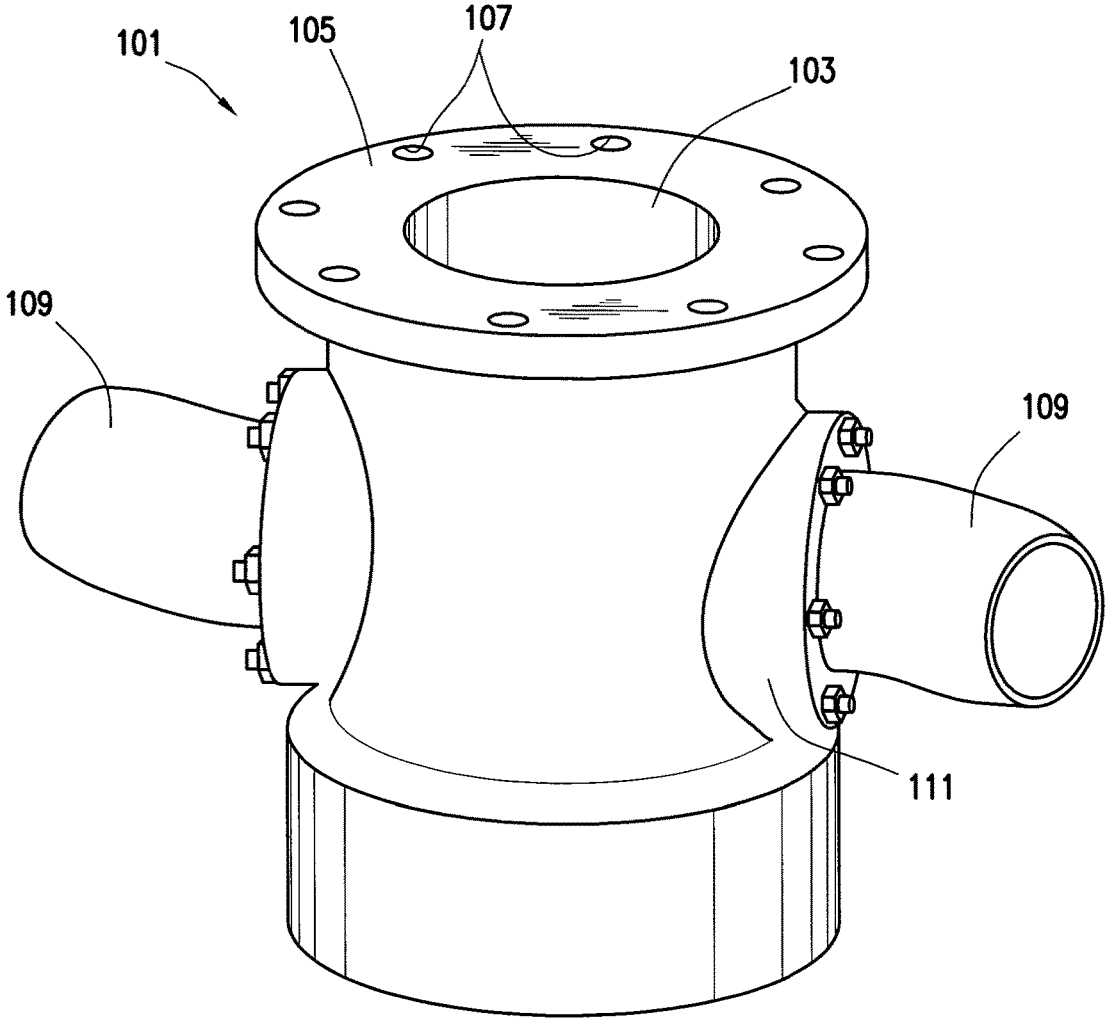
FIG. 1 depicts an isometric view of a turbo jet mixer in accordance with at least one embodiment of this disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates generally to tank cleaning devices. Specifically, the disclosure is directed to devices for preventing sludge from forming at the bottom of a storage tank and/or for removal of sludge from the bottom of a storage tank. In other embodiments, this disclosure is directed to devices for blending or mixing of fluids within a storage tank.

Figure 2:
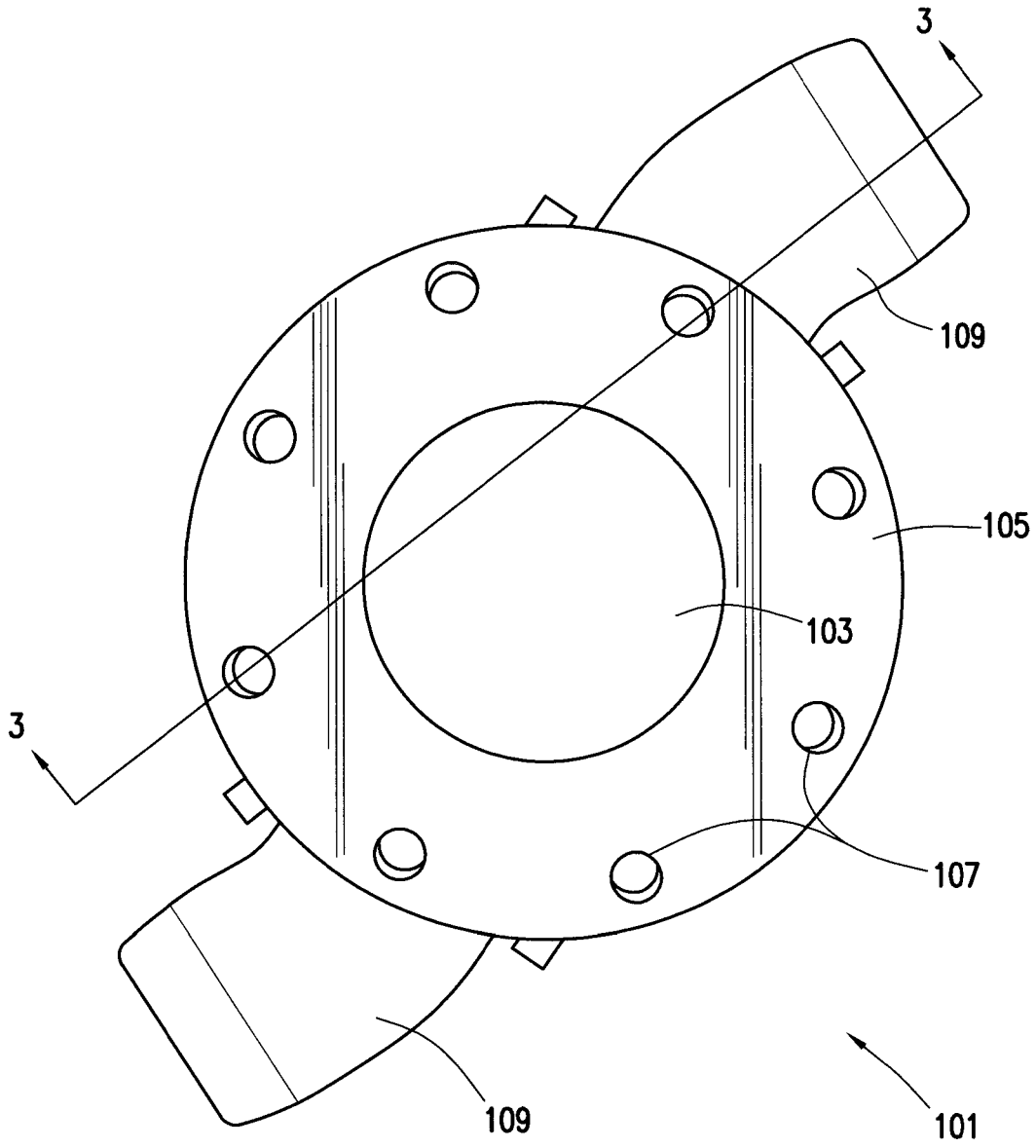
FIG. 2 depicts an elevation view of the top of the turbo jet mixer of FIG. 1.
Figure 3:
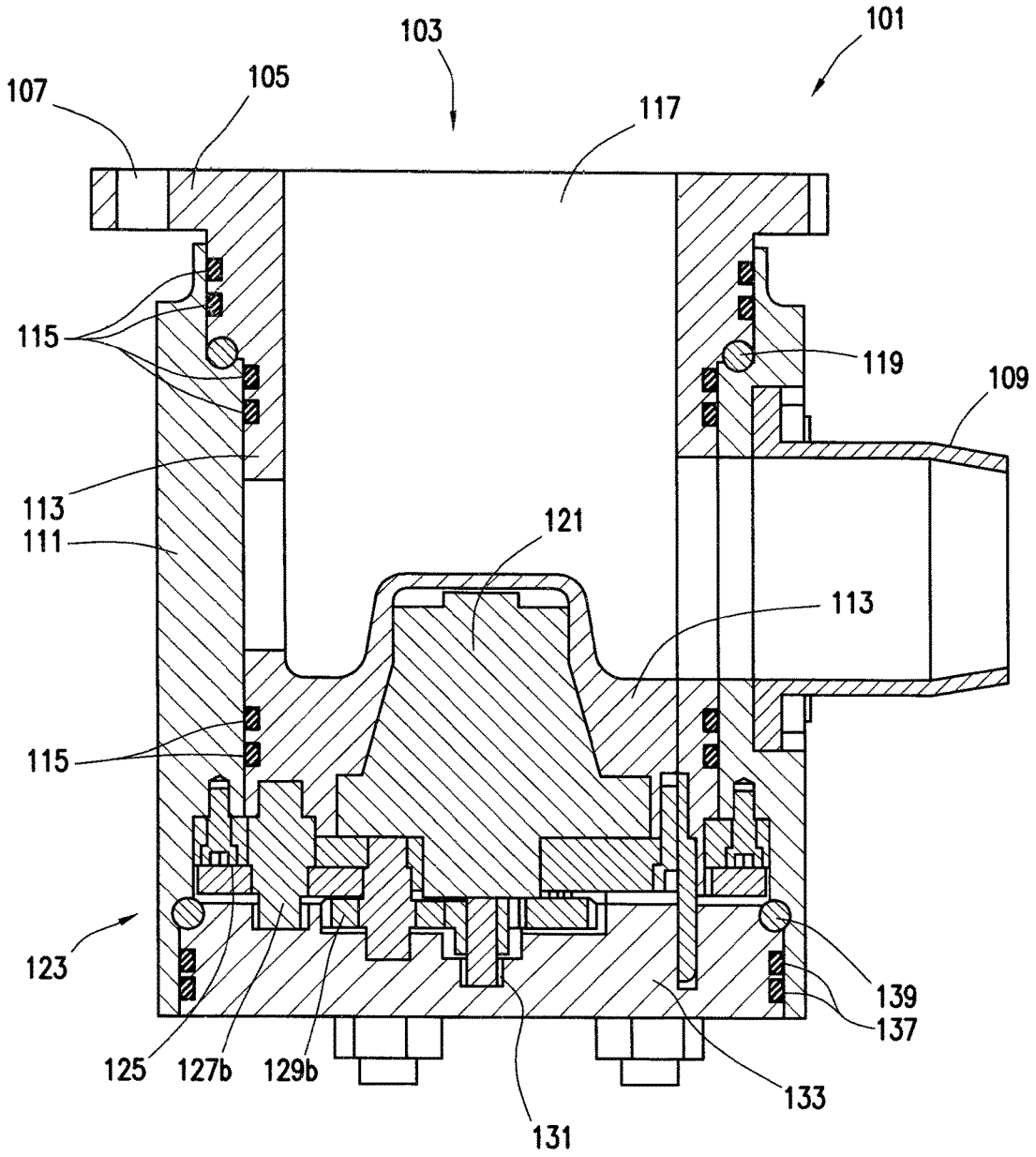
FIG. 3 depicts a cross section view of the turbo jet mixer of FIG. 2 along the line 3-3.

FIGS. 1-3 depict a turbo jet mixer 101 consistent with at least one embodiment of the present disclosure. Turbo jet mixer 101 includes an inlet 103 to allow a fluid to be pumped into the interior of turbo jet mixer 101. Inlet 103 may be configured to couple to a supply pipe (not shown) through, as depicted, a coupling flange 105. Coupling flange 105 may include one or more coupling features, such as the bolt holes 107 depicted in FIG. 1. In some embodiments, an adapter such as an elbow pipe (not shown) may be coupled to coupling flange 105 to orient turbo jet mixer 101 at an angle to vertical. For instance, a 45 degree elbow attached to coupling flange 105 will orient turbo jet mixer 101 at a 45 degree angle to vertical. In another embodiment, the adapter can also be welded. Further, those of ordinary skill in the art with benefit of this disclosure will recognize that any appropriate method of affixing could be employed to attach the adapter to turbo mixer jet 10.

Inlet 103 is fluidly coupled to one or more output nozzles 109. Output nozzles 109 may be coupled to outer housing 111. Output nozzles 109 may be positioned such that fluid flow therefrom may cause a resultant torsional force on outer housing 111 of turbo jet mixer 101.

As depicted in FIG. 3, coupling flange 105 is formed as part of inner housing 113. Inner housing 113 may include one or more seals 115 to provide a fluid seal between inner housing 113 and outer housing 111 to, for example, prevent fluid in inner chamber 117 from escaping turbo jet mixer 101 between inner and outer housings 113, 111. Inner housing 113 is positioned to remain stationary with respect to the supply pipe. Outer housing 111 is rotationally coupled to inner housing 113 and may rotate continuously. One or more bearings 119 may be positioned between inner and outer housings 113, 111 to, for example, reduce friction therebetween. One having ordinary skill in the art with the benefit of this disclosure will understand that bearing 119 may be any sort of bearing including without limitation a roller bearing or ball bearing.

In operation, fluid is pumped through inlet 103 into inner chamber 117 from the supply pipe. Fluid then flows out through output nozzles 109 where it may, for example, agitate and break up sludge which has agglomerated at the bottom of a storage tank (not shown). In one example, the sludge may be hydrocarbon solids or denser fluid phases of a crude hydrocarbon fluid. One having ordinary skill in the art with the benefit of this disclosure will understand that any fluid subject to separation or sludge deposit may be used with a turbo jet mixer 101 of the present disclosure. In other embodiments, the fluid which flows out through output nozzles 109 may, for example, stir or blend fluids within the storage tank.

In some embodiments, the fluid pumped into turbo jet mixer 101 may be the fluid stored in the storage tank. In some embodiments, the fluid may be skimmed from the surface of the fluid stored in the storage tank or filtered therefrom. In other embodiments, fluid introduced into the storage tank may enter the storage tank through turbo jet mixer 101, thus agitating the existing fluid while filling the storage tank.

The flow rate of the fluid through output nozzles 109, and thus the speed of the fluid when it enters the storage tank may be selected by varying certain parameters of turbo jet mixer 101 including, for example, the pressure and flow rate of fluid supplied; the diameter of the supply pipe, inner chamber 117, and output nozzles 109; the diameter of the aperture of output nozzles 109, etc.

Output nozzles 109 may be positioned such that fluid flow therefrom may cause a resultant torsional force on outer housing 111 of turbo jet mixer 101. For example, as depicted in FIGS. 1, 2, output nozzles 109 may be positioned offset from the center of outer housing 111, thereby creating an imbalanced torque on outer housing 111. The imbalanced resultant torque on outer housing 111 imparts a rotational force thereon and causes outer housing 111 to rotate. In some embodiments, output nozzles 109 may be formed as an integral part of outer housing 111. In other embodiments, output nozzles 109 may be formed separately from outer housing 111 and attached thereto.

Figure 5:
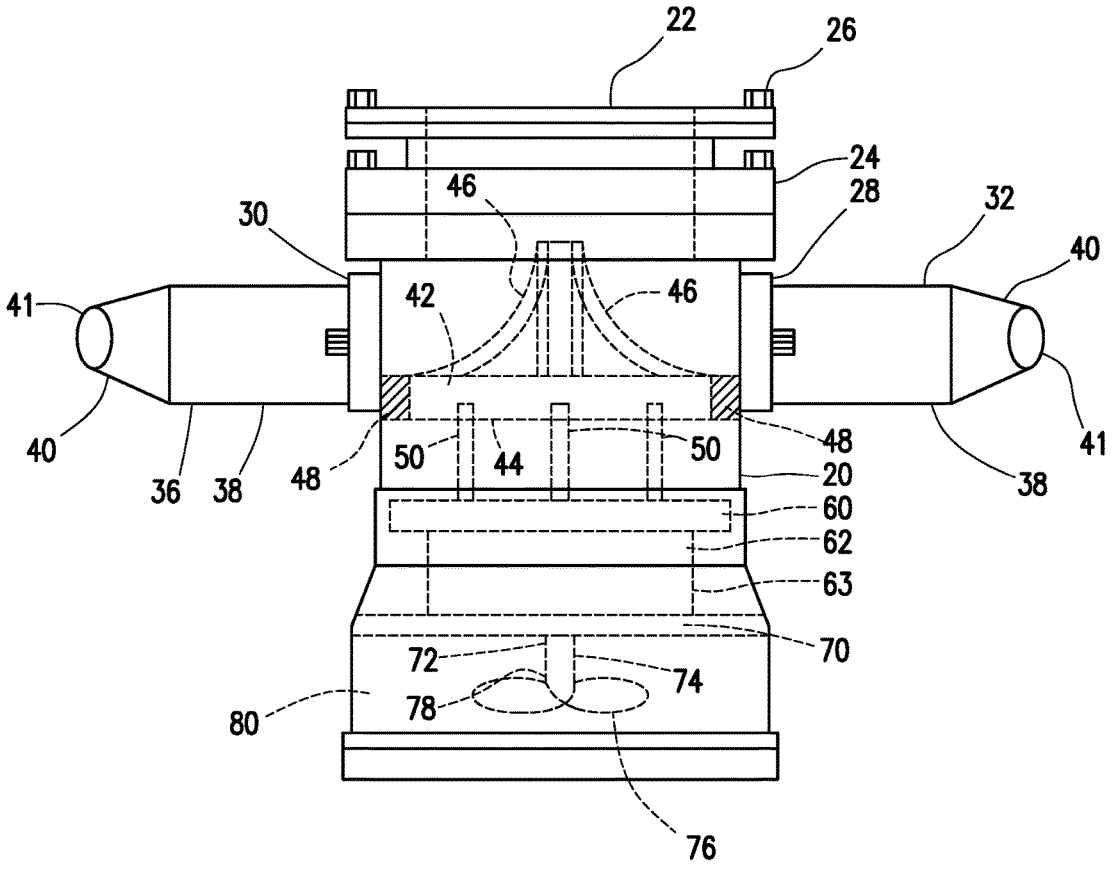
FIG. 5 depicts a side elevation of a turbo jet mixer in accordance with the present disclosure.
Figure 6:
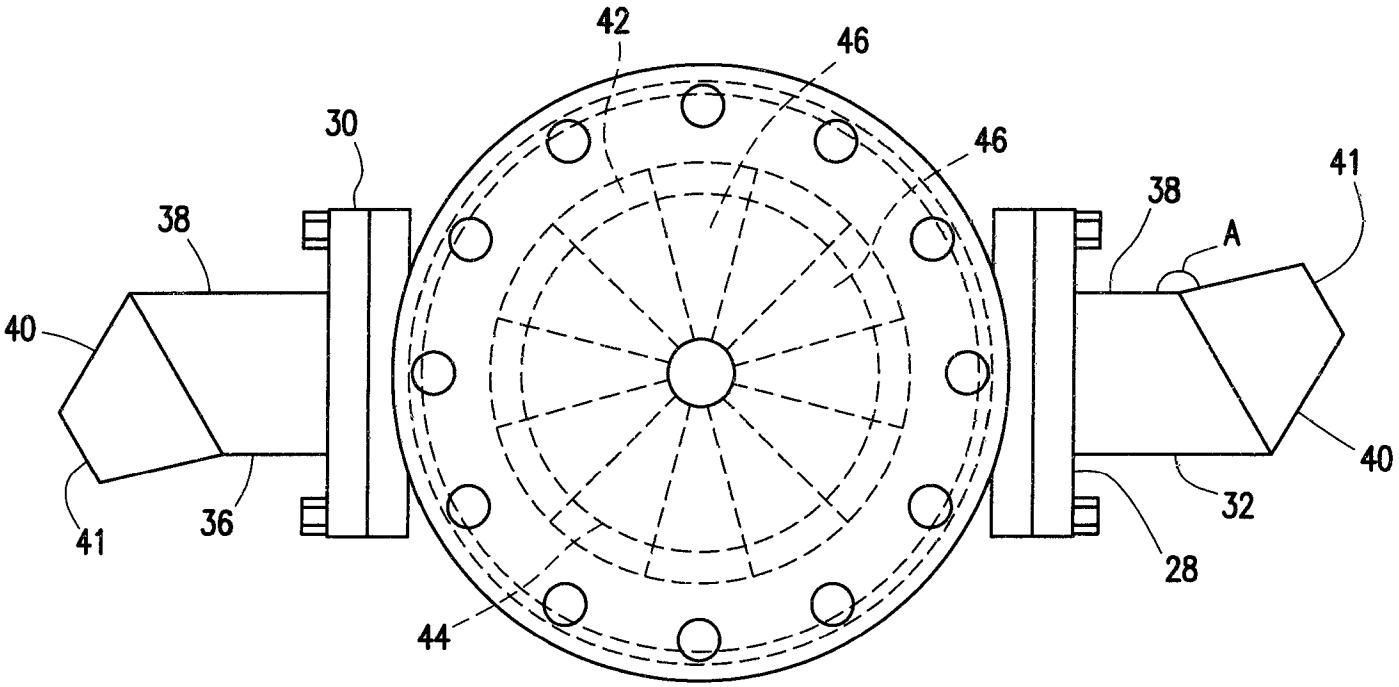
FIG. 6 depicts an elevation view of the bottom of the turbo jet mixer of FIG. 5.

In other embodiments, such as that depicted in FIGS. 5, 6, output nozzles 32, 36 may include an angled portion 40, to accomplish the same. Flanges 28, 30 are also provided on opposing sides of housing 20 to facilitate attachment of nozzles 32, 36. Any appropriate method of attachment could be employed to affix flange 28, 30 to nozzles 32, 36. Angle A is defined between a horizontal portion 38 and an inclined portion 40 of the nozzles 32, 36 (i.e., between the x-y axis). The angle A in FIG. 6 may be varied to vary the speed of rotation of the turbo jet mixer in some embodiments. In yet another embodiment, the nozzle may be designed such that the angles A and B are field adjustable. Orifice 41 is defined at an end portion of the nozzles 32, 36. In one embodiment, nozzles 32, 36 are shaped like truncated cones. In other embodiments, the shape and/or dimensions of nozzles 32, 36 may be selected depending on the viscosity of the fluid that will be re-circulated therethrough.

Figure 4:
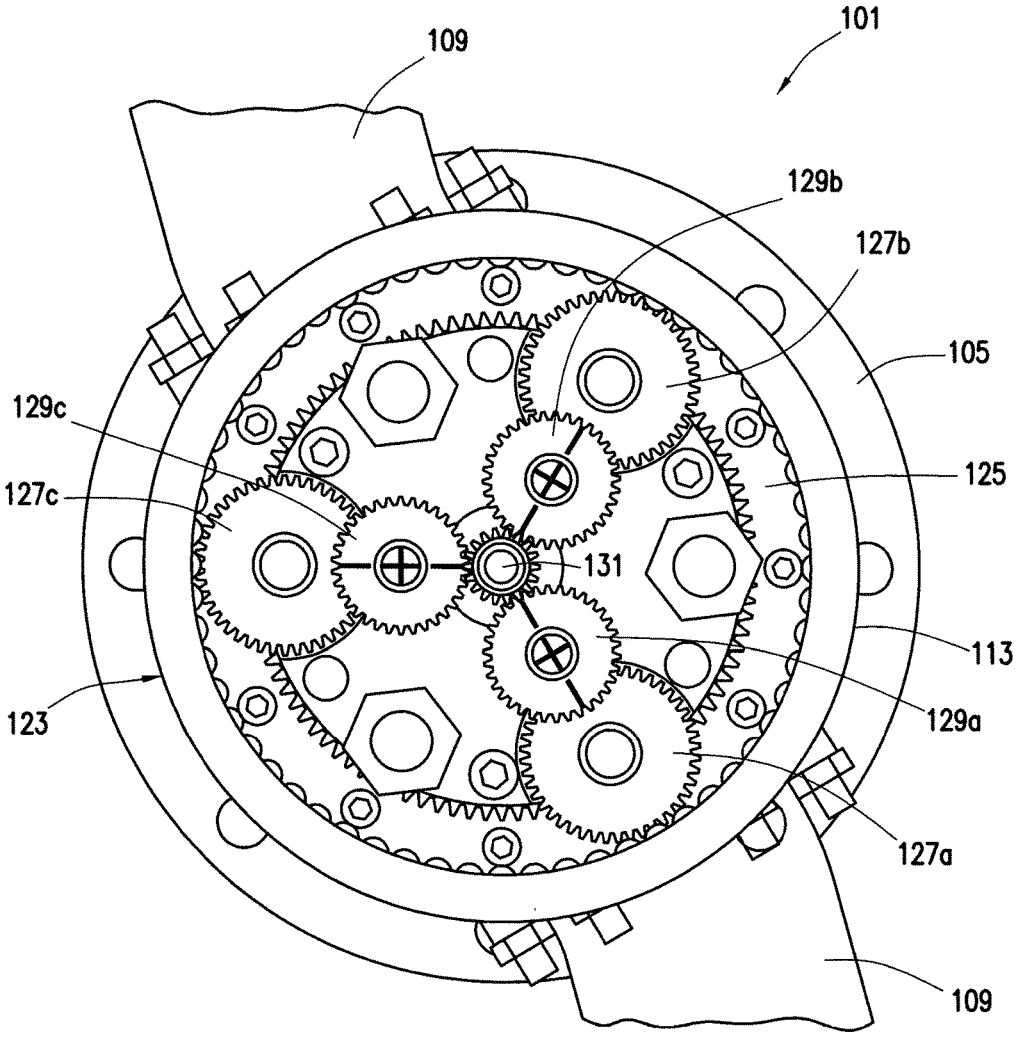
FIG. 4 depicts a gear arrangement of a turbo jet mixer in accordance with at least one embodiment of this disclosure.

Referring back to FIG. 3, in order to control the speed of rotation of outer housing 111, embodiments of the present disclosure may include a speed limiting device. In one embodiment, depicted in FIGS. 3, 4, the speed limiting device is dashpot 121. Dashpot 121 is a continuously rotating dashpot which, as known in the art, increases resistance to turning of its drive shaft as the speed of its drive shaft increases. Dashpot 121 is operatively coupled to outer housing 111 through a gearbox 123, here depicted as a compound epicyclic or compound planetary gear system. One having ordinary skill in the art with the benefit of this disclosure will understand that any gearing system to connect outer housing to dashpot 121 may be substituted within the scope of this disclosure. In the embodiment depicted in FIG. 4, ring gear 125 is coupled to outer housing 111. Ring gear 125 meshes with outer planet gears 127*a-c*. Outer planet gears 127*a-c* mesh in turn with inner planet gears 129*a-c* respectively. Inner planet gears 129*a-c* mesh with sun gear 131 which is coupled directly to dashpot 121. Here, outer and inner planet gears 127*a-c*, 129*a-c* are stepped gears (Outer and inner planet gears 127*a*, 129*a* are depicted as transparent to show the meshing of the hidden gears). Sun gear 131 therefore rotates at a higher speed than outer housing 111, thereby increasing the resistance to rotation provided by dashpot 121. The gear ratio of gearbox 123 may be selected to vary the overall rotation speed of outer housing 111 for a given configuration. In some embodiments, the gear ratio may be 40:1. In other embodiments, the gear ratio may be 70:1. One having ordinary skill in the art with the benefit of this disclosure will understand that any gear ratio may be selected, and a different gear ratio may affect the speed of rotation of outer housing 111. Gearbox 123 may be sealed and filled with oil or grease in some embodiments, contained between outer gearbox housing 133 and inner housing 113. Outer gearbox housings 133 may be fluidly sealed against outer housing 111 by one or more seals 137. In some embodiments, in which outer gearbox housing 133 is stationary with respect to inner housing 113, bearing 139 may be included. Dashpot 121 may be mounted to inner housing 113. In some embodiments, the gears 125, 127*a-c*, 129*a-c*, 131 may be formed from carbon steel.

In other embodiments, such as that depicted in FIG. 5, turbo jet mixer 10 of the present disclosure includes housing 20 having inlet 22. As shown in the present embodiment, inlet 22 is defined by flanges 24, 26 that may be coupled to a pipe fitting (not shown). This configuration is shown for illustration purposes only. Any suitable configuration of flanges may be adopted to enable fluid communication with turbo mixer jet 10.

Stationery flow diverter 42 is provided within housing 20 which rotates. A stationary base 44 extends circumferentially around the inside diameter of housing 20. Static guide vanes 46 extend upwardly from base plate 44 and are attached to flange 24. O-rings 48 are disposed between base stationery flow diverter 42 and housing 20 to prevent fluid communication between inlet 22 and portions therebelow.

With continuing reference to FIGS. 5 and 6, connecting ribs 50 extend downwardly from stationery flow diverter 42 and are attached to a gear first shaft 60 of gear 62. In one embodiment gear 62 is a cycloidal gear made by Sumitomo Heavy Industries of Germany. In other embodiments, a planetary gear or any suitable gear may be employed. Gear shaft 60 is fixed in space when it is attached to connecting ribs 50.

When gear 62 is a cycloidal gear, housing 20 is attached to cycloidal gear housing 63. The input shaft (not shown) of gear 62 is attached to flywheel 70. When housing 20 rotates due to flow through nozzles 32, 36, flywheel 70 may rotate at a faster speed than nozzles 32, 36 due to the gear ratio of gear 62.

The cycloidal gear is typically used as a speed reducing gear. In certain embodiments, the cycloidal gear will be in a backdrive arrangement. In such an arrangement, shaft 74 of the cycloidal gear is held stationary by attachment to static guide vanes 46. Cycloidal gear housing 63, which is typically stationary, may be affixed to housing 20, which will rotate due to the jet action of nozzles 32, 36. Shaft 60 is attached to flywheel 70. In some embodiments, the drive ratio between flywheel 70 and housing 20 may be 87:1. Gear 62 may be used in a back-drive to benefit from the friction of gear 62 in helping to limit the maximum rotational speed of housing. Flywheel 70 typically adds inertial resistance to rotational acceleration and smooths out rotational speed variation. In certain embodiments, flywheel 70 may not limit max speed, which may be accomplished by viscous forces on paddles 76 and the back-drive friction.

Proximate end portion 72 of shaft 74 extends downwardly from flywheel 70. Drag limiter or paddles 76 are attached to distal end 78 of shaft 74. Drag limiter or paddles 76 are immersed in a splash lubricant/hydraulic fluid reservoir 80. The contents of reservoir 80 also lubricate gear 62. The immersed paddles 76 also provide some resistance that modulates the rotational speed of the flywheel 70. In one embodiment, flywheel 70 is capable of 87 rotations for each rotation of shaft 60.

In another embodiment, splash lubricant 80 may be sealed within an enclosure at a bottom portion of housing 20 to facilitate the installation of turbo jet mixer 10 orientations other than the upright orientation.

In operation, a re-circulated fluid such as crude oil stored in a tank is introduced into the turbo jet mixer 10 through inlet 22 causing the housing 20 to rotate, thereby rotating gear 62. Recirculated fluid is directed toward nozzle orifices 41 by static guide vane 46. In some embodiments, fluid exiting nozzle orifices 41 into the storage tank re-suspends sludge that may have formed or is in the process of forming in the storage tank. In other embodiments, fluid exiting nozzle orifices 41 into the storage tank serves to mix or blend fluid within the storage tank. In other embodiments, fluid exiting nozzle orifices 41 may be one or more fluids from outside the storage tank to be mixed with fluids already within the storage tank. Rotation of the housing 20 can be modulated by varying the angle A between the x-y axis to change thereby varying the impact of the force generated by the change in the direction of the fluid that is directed through nozzles 32, 36. One of ordinary skill in the art will appreciate that the rotational speed of housing 20 will increase as the angle A is increased. The vertical direction of swirl generated by fluid exiting nozzles 32, 36 can also be varied by adjusting angle B as desired by an operator of jet mixer 10 to achieve a suitable fluid jet from nozzles 32, 36.

Other factors that may affect the speed and operation of jet mixer 10 include the viscosity and/or temperature of splash lubricant inside reservoir 80. It will be understood that as the rotational speed of housing 20 increases, the temperature of splash lubricant inside reservoir 80 will increase. Therefore, the splash lubricant will become less viscous and will have less resistance to paddles 76 rotating therein. As a result, the rotational speed of housing 20 will increase as the temperature of the splash lubricant increases.

Flywheel 70 acts to control the rotational speed of housing 20. In certain embodiments, the viscosity of the fluid being re-circulated varies depending upon the amount of sludge present in the fluid. Because sludge may not be evenly distributed throughout the fluid, slugs of highly viscous fluid may pass through turbo mixer jet 10, followed by less viscous slugs. In the absence of flywheel 70, the more viscous slugs would slow the rotational speed of housing 20 as it passed though nozzle orifices 41 and the less viscous slugs would increase the rotational speed of housing 20 as it passed through nozzle orifices 41. The rotational inertia of flywheel 70 may keep the speed constant when the unit encounters variations in fluid viscosity. In this way, flywheel 70 causes the rotational speed of housing 20 to be modulated such that the rotational speed varies less with non-evenly distributed sludge than would occur without flywheel 70.

Figure 7A:
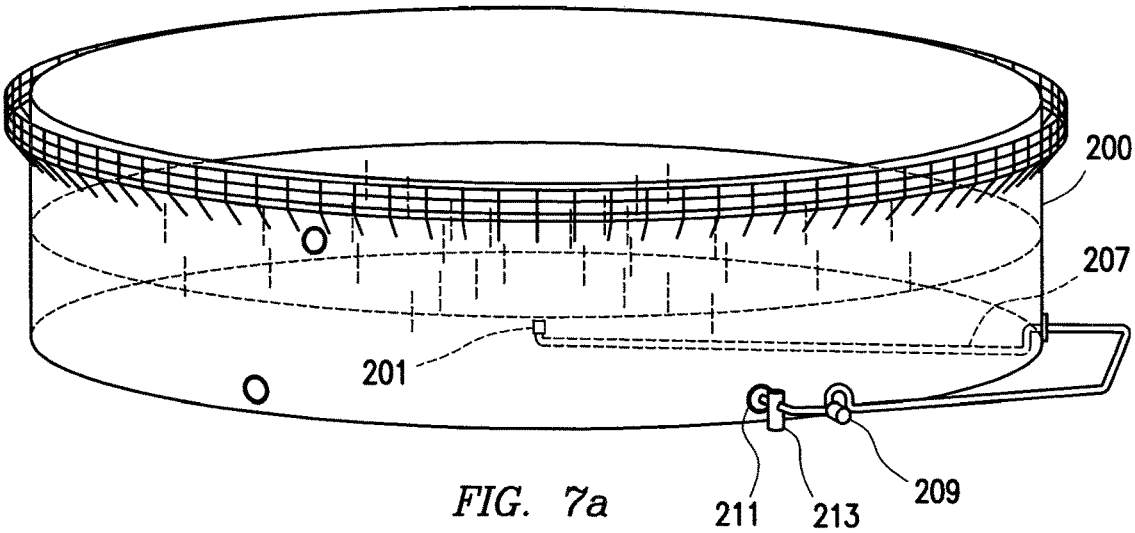
FIGS. 7*a*, 7*b* depict a configuration of a turbo jet mixer in accordance with the present disclosure in a storage tank.
Figure 7B:
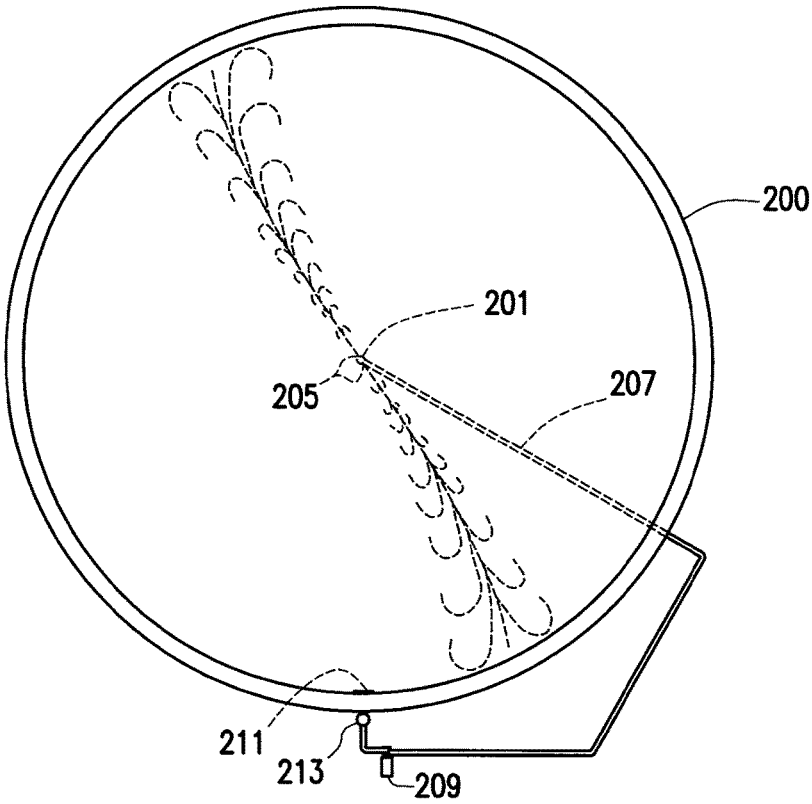

As shown in FIGS. 7*a*, 7*b*, one or more turbo jet mixers 201 may be disposed in the middle of storage tank 200. In such center mount embodiments, fluid exits nozzle orifices 203 of output nozzles 205 simultaneously. In a turbo jet mixer 201 having two nozzles 205, fluid will exit in diametrically opposed directions as shown in FIG. 7*b*. In this embodiment, turbo jet mixer 201 is operated in a recirculating configuration. Supply pipe 207 fluidly couples turbo jet mixer 201 with pump 209. Pump 209 is connected to an aperture 211 in storage tank 200 and pumps fluid from storage tank 200 through supply pipe 207 to turbo jet mixer 201. One or more filter stages 213 may be included to, for example, prevent sludge and sediment from entering pump 209.

Figure 8A:
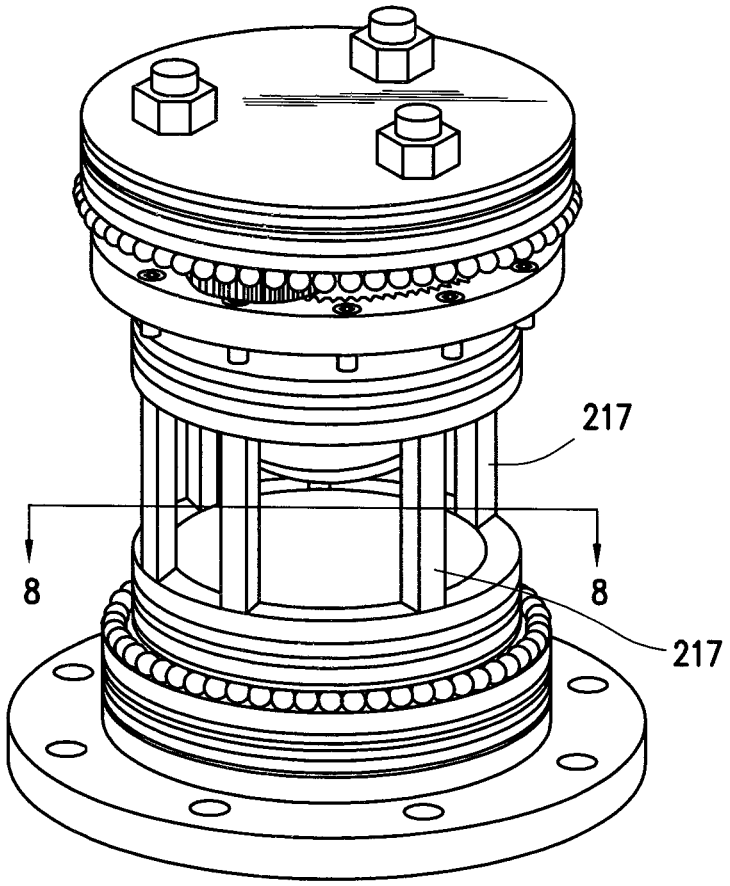
FIG. 8*a* depicts a turbo jet mixer of FIGS. 7*a*, 7*b* with outer housing removed.
Figure 8B:
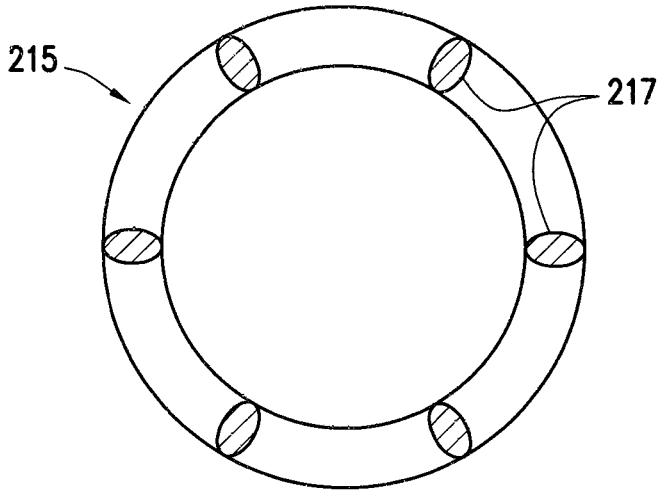
FIG. 8*b* depicts a cross section view of the inner housing of the turbo jet mixer of FIG. 8*a* taken at line 8-8.

As shown in FIGS. 8*a*, 8*b*, in some center mount embodiments, inner housing 215 of turbo jet mixer 201 may include a series of columns or vanes 217 to connect the mounting flange 219 portion and the gearbox 221 portion of turbo jet mixer 201. Thus, interior cavity 223 is exposed to output nozzles 205 at all times as outer housing (not shown) rotates about inner housing 215.

In another embodiment show in FIGS. 9*a*, 9*b*, one or more turbo jet mixers 301*a-c* may be disposed around the perimeter of storage tank 300. In this embodiment, turbo jet mixers 301*a-c* are operated in a recirculating configuration. Supply pipe 307 fluidly couples turbo jet mixers 301*a-c* with pump 309. Pump 309 is connected to an aperture 311 in storage tank 300 and pumps fluid from storage tank 300 through supply pipe 307 to turbo jet mixers 301*a-c*. One or more filter stages 313 may be included to, for example, prevent sludge and sediment from entering pump 309. FIGS. 9*a*, 9*b* depict turbo jet mixers 301*a-c* as being fed from a single pump 309, but one having ordinary skill in the art with the benefit of this disclosure will understand that any supply configuration could be used, including each turbo jet mixer 301*a-c* having its own pump 309.

Figure 10B:
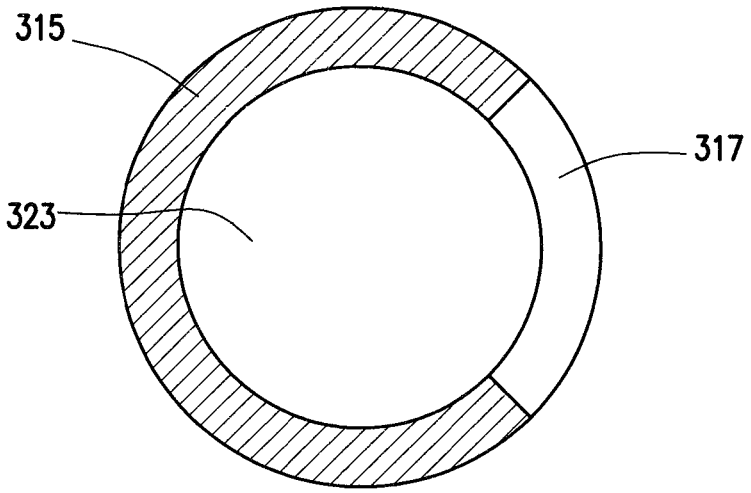
FIG. 10*b* depicts a cross section view of the inner housing of the turbo jet mixer of FIG. 10*a* taken at line 10-10.
Figure 10A:
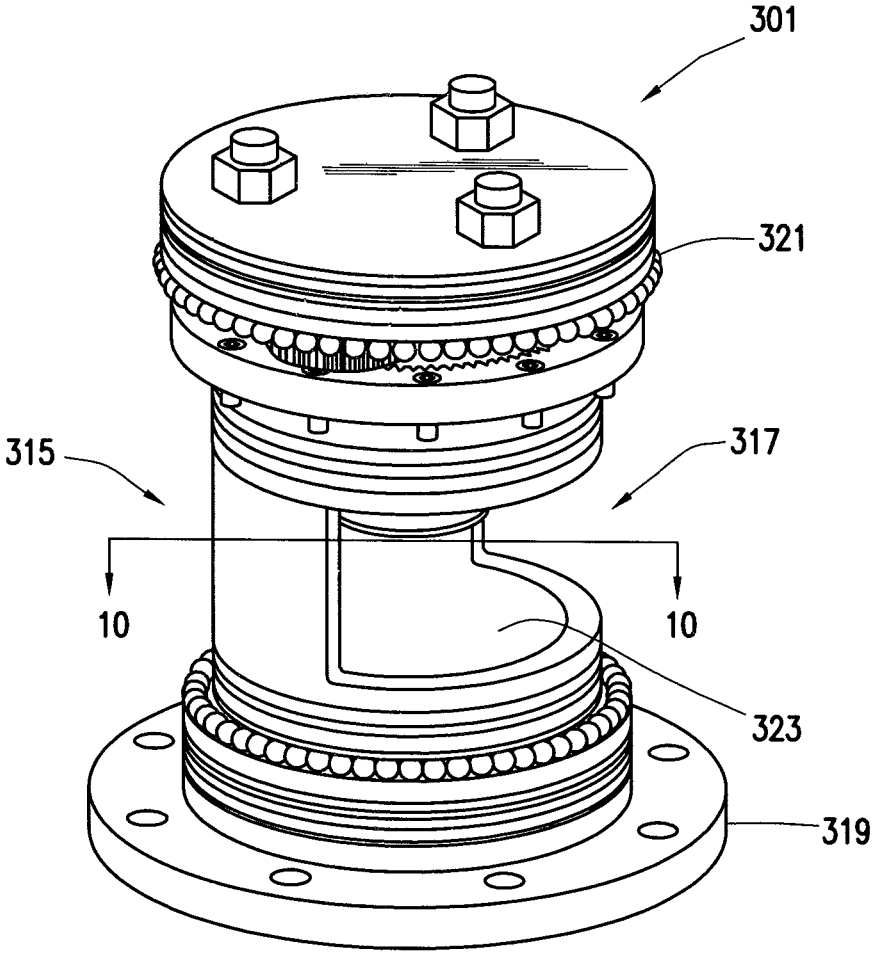
FIG. 10*a* depicts a turbo jet mixer of FIGS. 9*a*, 9*b* with outer housing removed.

In an edge mounted embodiment such as that depicted in FIGS. 9*a*, 9*b*, fluid may be prevented from being ejected toward the near wall. In one embodiment, as depicted in FIGS. 10*a*, 10*b*, inner housing 315 of turbo jet mixer 301 may be solid save for a window 317 on one side of inner housing 315 between the mounting flange 319 portion and the gearbox 321 portion of turbo jet mixer 301. Thus, interior cavity 323 is exposed to an output nozzles (not shown) only when the output nozzle is aligned with window 317. Thus, the direction in which output nozzles can jet fluid is constrained to only a portion of the full rotation of turbo jet mixer 301. By positioning the window 317 of inner housing 315 away from the closest wall, fluid is thereby only jetted into the middle of storage tank 300.

One having ordinary skill in the art with the benefit of this disclosure will understand that both center mounted and perimeter mounted turbo jet mixers may be used in the same storage tank.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions and alterations herein without departing from the spirit and scope of the present disclosure.

What is claimed is:

1. A turbojet mixer comprising:

an inner housing having an inlet, the inner housing including a coupling section, a generally tubular section, and an end plate, the interior of the generally tubular section defining an inner chamber;

an outer housing positioned substantially about the inner housing, the outer housing being rotationally coupled to the inner housing, the outer housing adapted to rotate relative to the inner housing, the outer housing having an inner wall;

a nozzle coupled to the outer housing, the nozzle coupled to an aperture in the outer housing to fluidly connect the inner chamber to the nozzle;

a continuously rotatable dashpot coupled to the inner housing; and a gearing mechanism coupled to the inner housing positioned to operatively couple a ring gear coupled to the outer housing to the dashpot, wherein the gearing mechanism is a compound epicyclic or compound planetary gear system, wherein the generally tubular section of the inner housing comprises a solid portion and a window positioned between a mounting flange and a gearbox, so that the solid portion prevents fluid communication between the inner chamber and the nozzle when the nozzle is substantially overlapping the solid portion, and the window allows fluid communication between the inner chamber and the nozzle when the nozzle is substantially overlapping the window through the rotation of the outer housing.

2. The turbo jet mixer of claim 1, wherein the inner housing further comprises a flange positioned to fluidly couple the turbo jet mixer to a supply pipe.

3. The turbo jet mixer of claim 1, wherein the generally tubular section of the inner housing comprises a series of vanes connecting the coupling section and the end plate, so that the inner chamber is exposed to at least a portion of the nozzle throughout a full rotation of the outer housing.

4. The turbo jet mixer of claim 1, wherein the nozzle is positioned to impart a rotational force on the outer housing through a resultant force from jetting fluid through the nozzle.

5. The turbo jet mixer of claim 4, wherein the nozzle is mounted at an angle to the outer wall of the outer housing.

6. The turbo jet mixer of claim 4, wherein the nozzle extends normally from the outer wall of the outer housing, and includes an angular deflection to impart the rotational force.

* * * * *